United States Patent [19]

Fitzpatrick

[11] 4,199,903

[45] Apr. 29, 1980

[54] EXPANDABLE ABRADING TOOL AND ABRASIVE INSERT THEREOF

[75] Inventor: Paul Fitzpatrick, Southfield, Mich.

[73] Assignee: Ex-Cell-O Corporation, Troy, Mich.

[21] Appl. No.: 897,626

[22] Filed: Apr. 19, 1978

[51] Int. Cl.[2] ..... B24D 9/00

[52] U.S. Cl. ..... 51/339; 51/364; 51/370; 51/206 R

[58] Field of Search ..... 51/206 R, 206 P, 206.4, 51/206.5, 207, 331, 338, 339, 340, 346, 350, 351, 352, 372, 375, 378, 380, 391, 364, DIG. 6, 345, 363; 269/48.1; 279/2 R

[56] References Cited

U.S. PATENT DOCUMENTS

| | | | |
|---|---|---|---|
| 1,792,800 | 2/1931 | Birgbauer | 51/DIG. 6 |
| 1,865,229 | 6/1932 | Birgbauer | 51/206 P |
| 2,115,210 | 4/1936 | Mulholland | 51/206 P |
| 2,725,694 | 12/1955 | Lukens | 51/364 X |
| 3,324,607 | 6/1967 | Niemiec | 51/206.4 X |
| 3,951,619 | 4/1976 | Frangipane | 51/206 P X |

FOREIGN PATENT DOCUMENTS

| | | | |
|---|---|---|---|
| 196154 | 4/1907 | Fed. Rep. of Germany | 51/340 |
| 958005 | 1/1957 | Fed. Rep. of Germany | 51/207 |

*Primary Examiner*—Harold D. Whitehead
*Assistant Examiner*—Robert P. Olszewski
*Attorney, Agent, or Firm*—Reising, Ethington, Barnard, Perry & Brooks

[57] ABSTRACT

An abrading tool (20, 20*a*, 20*b*) is disclosed as having a tapered arbor (22) and an abrasive insert 24 including a helical element (28) with a plurality of coils (30) that receive the arbor in an axially incompressibly mounted relationship. An abrasive strip (32) of a helical shape on the coils performs a machining operation upon tool rotation. The abrasive strip on each coil is spaced from the abrasive strip on adjacent coils. Nuts (40, 44, 46) threaded on the arbor provide a means for adjustably positioning the abrasive insert axially along the arbor to control the diameter of each coil in order to initially size the insert and to subsequently compensate for wear of the abrasive strip. Different embodiments disclosed include a helical spacer (34, 36) which spaces the coils of the helical element, coils which are directly engaged with each other and define a helical groove (64) that receives a spacer (66) located between the abrasive strip on each coil, and passages (56, 58, 60, 62) through the arbor and the insert for feeding fluid to the abrasive strip.

3 Claims, 10 Drawing Figures

EXPANDABLE ABRADING TOOL AND ABRASIVE INSERT THEREOF

TECHNICAL FIELD

This invention relates to an expandable abrading tool for use in sizing and finishing holes and also relates to an abrasive insert of the tool.

BACKGROUND ART

Abrading tools are used to size and surface finish holes during a machining operation in which an abrasive insert of the tool is inserted into the hole and rotated to machine the hole. A relatively small amount of material stock is usually removed during this type of machining operation since the abrasive grit size is normally sufficiently small so as to provide a smooth surface finish.

One type of abrading tool which is disclosed by the prior art utilizes an abrasive member and a carbide shoe or utilizes two or more abrasive members mounted for radial movement with respect to each other so that the tool can be inserted within the hole and then expanded to perform the machining operation as the tool is rotated. Machining takes place within the hole as the expanded tool is rotated. Such tools are disclosed by U.S. Pat. Nos: 1,841,343; 1,874,856; 1,903,343; 1,910,658; and 1,960,555.

Another type of abrading tool incorporates a sleeve having an axial slit which has a circumferential component of about 360 degrees or less. An abrasive or lapping compound can be supplied to the sleeve during tool rotation to perform abrading by what is referred to as lapping. Also, an abrasive grit can be secured to the sleeve to perform the abrading as the tool is rotated. Mounting of the sleeve on a tapered arbor and axial positioning therealong allows the diameter of the sleeve to be controlled as the width of the slit in the sleeve varies according to the axial position. Tools of this type are disclosed by U.S. Pat. Nos: 2,341,094 and 3,462,887.

Other abrading tools are disclosed by U.S. Pat. Nos: 604,933; 1,906,190; 3,324,607; and 3,828,489.

It is very important that the abrading tools are of precise sizes so that the holes are machined to the required diameters. Also, the abrasives surfaces of rotatable abrading tools wear during use. Some provision for compensating for such wear is advantageous in order to increase tool life during which holes can be finished and sized to the same diameter.

DISCLOSURE OF THE INVENTION

Objects of the invention are to provide an improved expandable abrading tool for use in sizing and finishing holes and to provide an improved abrasive insert for use with the tool.

In carrying out the above objects, the abrading tool includes a tapered arbor having a central axis of rotation and an outer surface of a frustoconical shape and the abrasive insert includes a helical element having a plurality of coils that receive the arbor in an axially incompressibly mounted relationship. An outer abrasive strip of a helical shape on the coils performs a machining operation as the tool is rotated within a hole. The abrasive strip on each coil is spaced from the abrasive strip on the adjacent coils. Nuts threaded onto the arbor engage axial ends of the abrasive insert and provide a means for adjustably positioning the insert axially along the arbor to control the diameter of each coil. The coils can be increased or decreased in diameter to initially size the insert and can be increased in diameter to compensate for wear of the abrasive strip.

The spaced relationship of the abrasive strip portion on each coil from the abrasive strip portions on adjacent coils allows the abrasive to be secured by a metal matrix which is plated on the helical element without any plating surface extending directly between the coils. The coils are thus free to slide circumferentially relative to each other as axial movement of the insert changes the diameters of the coils.

One preferred embodiment of the tool includes an abrasive insert having a helical spacer that spaces the coils of the helical element thereof while preventing movement of the coils toward each other. The spacer includes a helical metal spring engaged radially with the other surface of the arbor and engaged axially with the coils of the helical element. The spacer also includes a helical filler portion which fills the space between the metal spring and the outer abrasive strip on the coils. Alternatively, the spacer is disclosed as including a metal spring covered with a nonconductive coating. Metal plating which secures the abrasive strip to the helical element thus does not form on the nonconductive spacer spring and inhibit coil expansion.

Another preferred embodiment disclosed incorporates an abrasive insert whose helical element has coils that are engaged directly with each other and define a helical spacer groove which separates the abrasive strip on each coil from the abrasive strip on each adjacent coil. A spacer is received within the helical groove defined by the coils and is located in a radially spaced relationship with respect to the outer surface of the arbor between the portions of the abrasive strip on adjacent coils.

Passages in the tool arbor and in the abrasive inserts disclosed permit a fluid to be fed to the abrasive strip where the cutting operation takes place. These passages are provided in both the insert embodiment whose helical element coils are spaced from each other by the spacer and in the insert embodiment whose helical element coils are directly engaged with each other. Preferably, the passages in the insert are defined by axial formations in the coils of the helical elements. These axial formations may be located on one or both axial sides of each coil spaced circumferentially from each other to provide the flow of lubricating or coolant fluid to the abrasive strip from the passages in the arbor.

Leading and trailing ends of the helical insert are preferably tapered in order to facilitate the initial movement of the tool into the hole being machined and the subsequent movement of the tool back through the hole after the machining operation has been completed. Rotation of the tool in the proper direction tends to lock the helical element on the arbor against rotation. Also, an end coil of the helical insert may include an inwardly bent end portion which is received within an axially extending slot in the arbor to prevent rotation of the helical element on the arbor as the machining takes place with the tool inserted in the hole. The inwardly bent end portion of the helical element slides axially within the slot as the nuts which engage the insert are rotated to change the size of the helical coils.

BEST MODE FOR CARRYING OUT THE INVENTION

Figure 1:
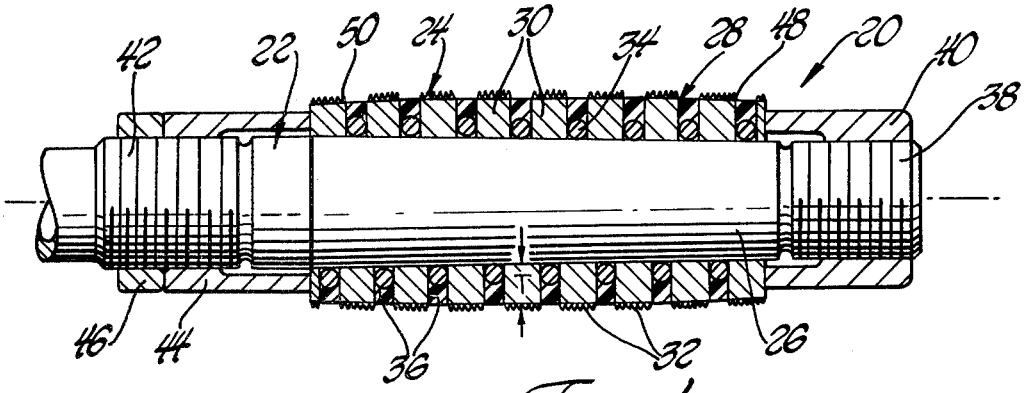
FIG. 1 is a side view taken partially in section of an expandable abrading tool and an abrasive insert thereof which are constructed according to the present invention.
Figure 2:
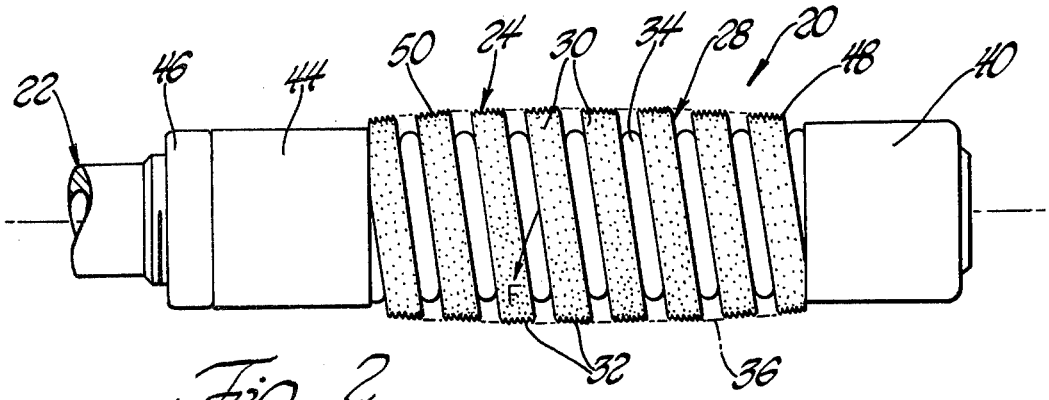
FIG. 2 is a side elevation view of the abrading tool and abrasive insert thereof shown in FIG. 1.

Referring to FIGS. 1 and 2 of the drawings, one preferred embodiment of an expandable abrading tool constructed according to the invention is indicated collectively by reference numeral 20 and includes a tapered arbor 22 and an abrasive insert 24 which is mounted on the arbor. Tool arbor 22 has a central axis of rotation A and includes an outer surface 26 of a frustoconical shape which has a smaller size at its right end than at its left end. Abrasive insert 24 includes a helical element 28 having coils 30 which receive the arbor in an axially incompressibly mounted relationship in engagement with the outer arbor surface 26. An outer abrasive strip 32 on the coils 30 has a helical shape that extends between the opposite ends of the insert. A helical spacer that is wound about the arbor between the coils 30 of the helical element includes a metal spring 34 that engages the outer arbor surface 26 in a radial direction and that also engages the coils in an axial direction so as to prevent movement of the coilss toward each other. A helical spacer portion 36 (FIG. 1) fills the void between the coils radially outward from the spring 34 and is located between the abrasive strip 32 on adjacent coils. The portion of the abrasive strip 32 on each coil is spaced from the abrasive strip portion on the adjacent coils as a result of the spacer 34, 36.

A threaded portion 38 at the smaller right end of the arbor 22 is shown in FIG. 1 and receives a nut 40 which is axially seated against the right end of the abrasive insert 24. A threaded portion 42 at the larger left end of the arbor 22 receives an engagement nut 44 that is seated against the left end of the abrasive insert 24. A jam nut 46 also received by the threaded portion 42 is engaged with the nut 44 in order to provide a locked condition thereof on the arbor. Nut 46 is threaded to the left to allow nut 44 to likewise be threaded toward the left so that the nut 40 can then be threaded to the left in order to move the abrasive insert 24 along the tapered arbor to increase the diameter of each coil 30 and thereby compensate for wear of the abrasive strip 32. Likewise, the nuts can move the insert 24 to the right or the left along the arbor to increase or decrease the coil diameters in order to initially size the insert for use. Nuts 40, 44 and 46 as well as the arbor threaded portions thus provide a means for adjustably positioning the abrasive insert 24 along the arbor 22.

Abrasive strip 32 preferably includes diamond or borazon grits which are secured to the coils 30 by a plating process wherein a matrix of nickel or another suitable metal is plated on the coils to secure the abrasive grits. When the insert 24 is moved along the tool arbor 22 to change the coil diameters, the coiils slide circumferentially with respect to each other. The spacer including the inner spring 34 and the outer spacer portion 36 prevents the metal plating which secures the abrasive grits from forming any bridging portions between adjacent coils so that the coils are free to slide circumferentially with respect to each other as the insert is moved.

It will be noted in FIGS. 1 and 2 that the abrasive insert 24 includes a leading end 48 which is tapered with a frustoconical shape and also includes a trailing end 50 which is likewise tapered with a frustoconical shape. Tool 20 is rotated as the leading end 48 is inserted within a hole to be machined and the tapered shape of the leading insert end pilots the tool during the initial movement into the hole and ensures proper alignment. After the machining is completed, the tool is pulled out of the hole as the rotation continues and the tapered trailing end 50 of the insert then guides the tool to prevent damage to the finished hole.

Tool 20 shown in FIGS. 1 and 2 is preferably rotated in a clockwise direction when viewed from the right looking toward the left. The resultant force vector F (FIG. 2) on each coil as the tool is rotated and inserted during the machining tends to wind the coils about the arbor 22 and thereby causes a locking action of the insert on the arbor to prevent relative rotation of the insert.

Figure 3:
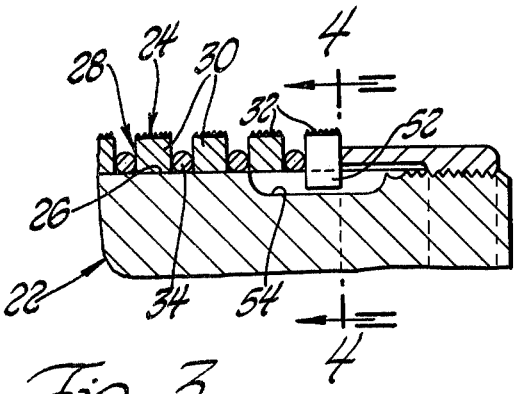
FIG. 3 is a partial sectional view similar to FIG. 1 showing a modification which prevents rotation of the abrasive insert on an arbor of the tool.
Figure 4:
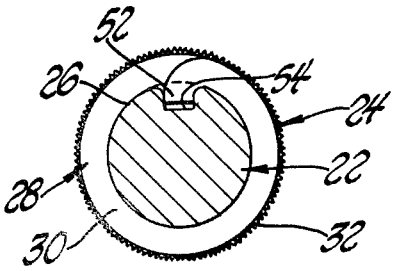
FIG. 4 is a cross-sectional view taken generally along line 4—4 of FIG. 3.

As seen in FIGS. 3 and 4, a modification of the abrasive insert 24 includes a leading tapered end 48 having an end coil with an inwardly bent portion 52. The arbor 22 includes an axially extending slot 54 adjacent the threaded portion 38 in which the nut 40 is received for engagement with the insert. Coil end portion 52 is received within the slot 54 in order to prevent rotation of the insert during use. Movement of the nut 40 to the left along the threaded portion 38 of the arbor slides the end portion 52 of the coil within the slot 54 in an axial direction so that the insert can be expanded in the manner previously described to compensate for wear of the abrasive strip 32.

Figure 5:
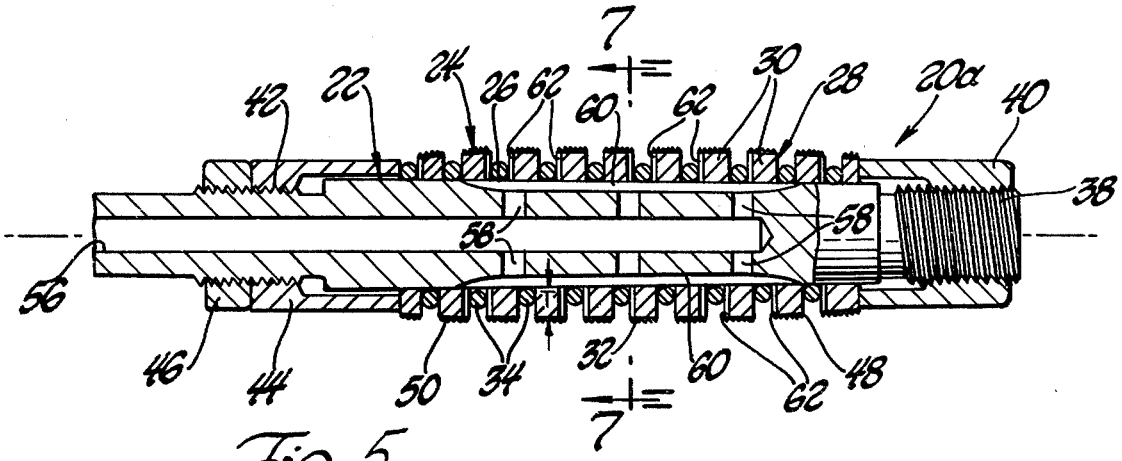
FIG. 5 is a side elevation view taken partially in section through another embodiment of an abrading tool and abrasive insert thereof constructed according to the present invention.
Figure 6:
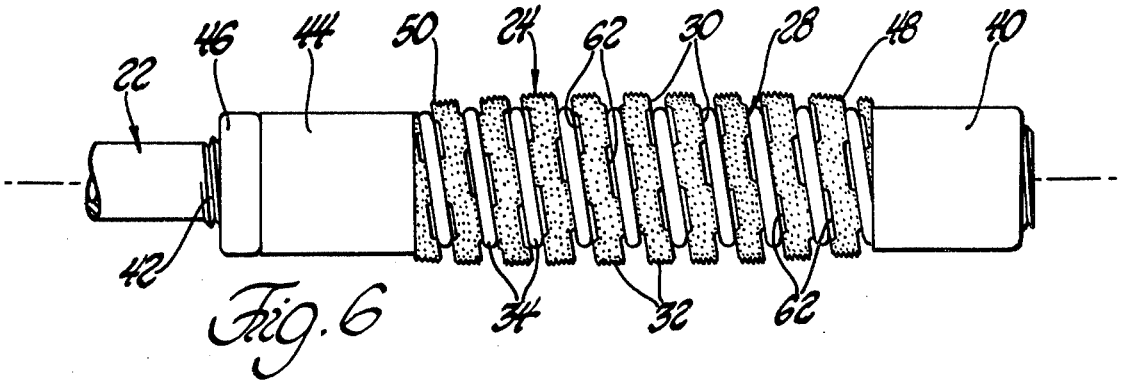
FIG. 6 is a side elevation view of the abrading tool and insert thereof shown in FIG. 5.
Figure 7:
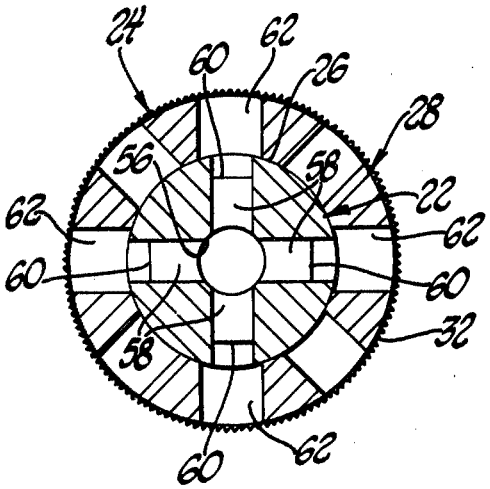
FIG. 7 is a cross-sectional view through the abrading tool and abrasive insert thereof shown in FIG. 5 taken along line 7—7 thereof.

Referring to FIGS. 5 and 6, another embodiment of the tool is indicated by reference numeral 20*a* and is of a construction similar to the tool 20 so that like reference numerals are applied to similar components. Likewise, much of the previous description applies to this tool embodiment as well except for the differences which will be pointed out. Arbor 22 of the tool 20*a* includes an axial passage 56 that extends along the axis A of mandrel rotation. Radial passages 58 extend outwardly from the central passage 56 and are communicated with longitudinally extending passages 60 in the outer arbor surface 26. Spacer spring 34 is coated with a suitable nonconductive covering so that the plating of the abrasive strip 32 on the coils 30 does not result in any plated surfaces that bridge between adjacent coils.

Abrasive insert 24 of the tool 20*a* includes radial passages which are defined by axial formations 62 in the coils 30. A suitable lubricating or coolant fluid is fed through the arbor passages 56, 58, and 60 to the insert and is then fed through the insert passages defined by the formations 62 outwardly to the abrasive strip 32 where the machining takes place. Machined chips can flow with the lubricating fluid along the helical space between the abrasive strip 32 on each coil so that the chips are removed from the hole which is being machined. The lubricating fluid is continually supplied to the tool from a suitable pump and is preferably filtered so as to remove the machined chips during each cycle.

Figure 8:
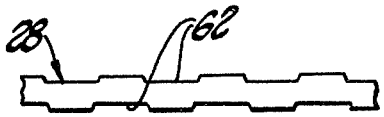
FIGS. 8 and 9 show two different pieces of straight wire for forming the helical element so that the resultant abrasive insert of the tool includes radial passages.
Figure 9:
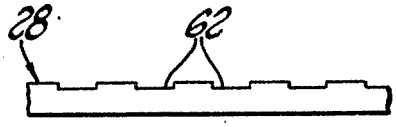

The helical element 28 of the tool embodiment **20*a* shown in FIGS. 5 and 6 is preferably made by winding square metal wire around a suitable surface. The metal wire can be crimped before the winding as shown in FIG. 8 so as to define the formations 62 for supplying the lubricating fluid on both axial sides of each coil. Alternatively, the formations 62 can be formed as shown in FIG. 9** on only one axial side of the wire.

Figure 10:
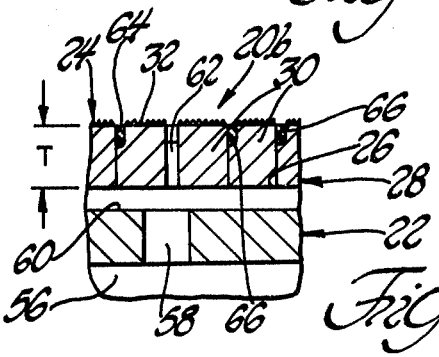
FIG. 10 is a partial view similar to FIGS. 1 and 5 but showing another embodiment of the abrasive insert of the tool.

Referring to FIG. 10, another embodiment of the tool is indicated by reference numeral **20*b* and is similar to the other two embodiments such that like reference numerals are utilized and much of the previous description is applicable to this tool as well, except as will be noted. However, the coils 30 of the abrasive insert of tool 20*b* are engaged axially with each other rather than being spaced as with the coils of the other tool embodiments. Coils 30 include a spacer groove 64 that cooperatively define a helical space along the insert between the portion of the abrasive strip 32 on each of the coils. A suitable nonconductive spacer 66 is received within the spacer groove 64 so as to prevent any of the plating which secures the abrasive from bridging between adjacent coils. Coils 30 are thus free to move circumferentially with respect to each other as the coil diameter is increased or decreased. The spacer 66 has a smaller diameter than the abrasive strip 32 so as to provide a path along which machine chips can be removed from the hole being machined. Coils 30 also include formations 62 which feed fluid supplied from the arbor 22 to the abrasive strip for cooling and chip removal during the machining. The fluid flows out through the spacer groove 64 at spaced voids in the spacer 66**.

To make the helical insert of each of the embodiments which has been described, the helical element thereof is first wound from a suitable wire in the manner previously described and the insert is then ground to define the tapered ends 48 and 50 for guiding the tool. The coils 30 are also ground between the tapered ends so that the mounted insert has an axial intermediate portion with a generally constant outer diameter. The ground helical element has a constantly increasing thickness T starting at a point just to the right of the trailing end 50 and moving toward the leading tapered end 48 of the insert. As the expansion of the insert takes place by movement thereof to the left along the arbor 22, the coils 30 are each expanded the same amount so that the outer diameter of the intermediate insert portion is increased back to its original diameter in order to compensate for the wear of the abrasive strip 32. Likewise, the leading and trailing ends 48 and 50 of the insert are expanded by the movement of the insert and compensation for wear of the abrasive thus takes place.

While the best mode for practicing the invention has been described herein in detail, those familiar with this art will recognize various alternative ways for practicing the invention as defined by the following claims.

What is claimed is:

1. An abrading tool comprising: a tapered arbor having a central rotational axis and an outer surface of a frustoconical shape; the arbor having a smaller leading end including a threaded portion and a larger trailing end including a threaded portion; the leading end of the arbor also including an axially extending slot; an abrasive insert mounted on the arbor between the threaded portions thereof; said insert including a metallic helical element having a plurality of coils wound about the arbor; an outer abrasive strip on the coils for performing a machining operation; the insert also including a helical spacer wound about the arbor between the coils of the helical element so as to space the abrasive strip on each coil thereof from the abrasive strip on the adjacent coils thereof while concomitantly preventing movement of the coils toward each other; the insert having leading and trailing tapered ends; the tapered leading end of the insert including an end coil having an inwardly bent end portion received within the axially extending slot of the arbor in order to prevent rotation of the insert on the arbor; and positioning nuts received by the threaded portions of the arbor and engaged axially with the ends of the insert to provide axial positioning thereof along the arbor such that nut rotation can move the insert along the arbor to control the diameter of each coil of the helical element in order to initially size the insert and to subsequently compensate for wear of the abrasive strip, and the bent end portion of the leading end of the insert sliding axially within the slot in the arbor to permit axial movement of the insert on the arbor as the diameter adjustment of the insert takes place.

2. An abrading tool as in claim 1 wherein the arbor includes fluid passages, and the abrasive insert including radially extended passages for feeding fluid from the arbor to the abrasive strip where cutting takes place.

3. An abrading tool as in claim 2 wherein the passages in the abrasive insert comprise axial formations in the coils of the helical element.

* * * * *